United States Patent [19]

Kikuchi

[11] 4,092,134

[45] May 30, 1978

[54] ELECTRIC DUST PRECIPITATOR AND SCRAPER

[75] Inventor: Yosio Kikuchi, Toyama, Japan

[73] Assignee: Nipponkai Heavy Industries Co., Ltd., Toyama, Japan

[21] Appl. No.: 692,391

[22] Filed: June 3, 1976

[51] Int. Cl.[2] ..... B03C 3/16

[52] U.S. Cl. ..... 55/109; 55/112; 55/135; 55/154; 55/151

[58] Field of Search ..... 55/9, 105, 109, 112, 55/121, 135, 139, 151, 154, 157, 295–297

[56] References Cited

U.S. PATENT DOCUMENTS

| | | | |
|---|---|---|---|
| 1,371,995 | 3/1921 | Nesbit | 55/9 |
| 2,215,807 | 9/1940 | Derry | 55/135 |
| 2,599,842 | 6/1952 | King, Jr. | 55/296 |
| 2,992,699 | 7/1961 | Jarrinen | 55/105 |
| 3,529,404 | 9/1970 | Quissek | 55/105 |
| 3,792,572 | 2/1974 | Turkin | 55/269 |

FOREIGN PATENT DOCUMENTS

| | | | |
|---|---|---|---|
| 215,135 | 11/1941 | Switzerland | 55/151 |
| 643,363 | 9/1950 | United Kingdom | 55/135 |
| 819,989 | 9/1959 | United Kingdom | 55/135 |

*Primary Examiner*—Bernard Nozick

*Attorney, Agent, or Firm*—Blanchard, Flynn, Thiel, Boutell & Tanis

[57] ABSTRACT

An electric dust precipitator comprising a chamber, a pair of dust collecting electrode groups, disposed in parallel with each other in the gas-flow direction in the chamber, the electrode groups being spaced apart by a distance of more than 400 mm, each electrode being made of a tubular member through which a cooling fluid for controlling the temperature thereof is passed and a plurality of discharging wires disposed in parallel with and between the dust collecting electrode groups wherein a high direct current voltage is applied between the discharging wires and the dust collecting electrodes, and a control system including a detecting means which detects the number and quantity of spark discharges caused by reverse ionization per unit time and a control means which controls the temperature of the cooling fluid with aid of a detected signal.

16 Claims, 20 Drawing Figures

ELECTRIC DUST PRECIPITATOR AND SCRAPER

FIELD OF THE INVENTION

This invention relates to an electric dust precipitator, more particularly to an improved electric dust precipitator in which the dust precipitated on dust collecting electrodes can be readily removed and the temperature of the dust collecting electrodes can be precisely controlled.

BACKGROUND OF THE INVENTION

The electric dust precipitator, in principle, comprises a pair of opposite dust collecting electrodes and a discharging wire disposed intermediately therebetween, which are positive and negative electrodes, respectively. When a high direct current voltage is applied between the electrodes and the wire, the electric field generated near the discharging wire is distorted so that a negative corona discharge may take place.

When a gas to be treated, for example, a waste gas containing smoke dust is fed through the space between the dust collecting electrodes and the discharging wire, i.e., through the discharging region, dust particles in the gas are negatively charged and then attracted to the dust collecting electrodes.

The method for removing fine particles in the gas in accordance with the above-described principle is known to be highly effective for dust precipitation.

All the prior electric dust precipitators depend on the above principle, though modifications and variations are, of course, made in practice. One of the improvements is made in accordance with the removal of the dust precipitated on dust collecting electrodes. Usually, the collected dust is removed in a mechanical manner. In one manner, dust collecting electrodes are shocked or vibrated by means of a hammer to knock off the collected dust. In an alternate manner, a slider or scraper is slidably moved along the surface of dust collecting electrodes to scrape off the dust.

The former method, however, has serious drawbacks in that first of all, a shock wave caused by the hammer is so violent that beams supporting the electrodes tend to fail. Particularly, if the dust collecting electrode is of a tubular type through which cooling water is passed, failure or cracks of the electrodes or joints between the electrodes and the beams (or headers) may result in leakage of water. Besides, the shock given by the hammer is partly absorbed by the cooling water within the tubular electrodes resulting in insufficient vibration of the electrodes. Further, it is difficult to effectively knock off highly adhesive dust even at more accelerated vibrations of the hammer. Such insufficient removal of dust necessitates periodic suspension of operation to clear the electrodes.

In addition, the dust which has adhered to the electrodes instantaneously drops immediately after the hammer makes impact with the electrodes. Upon settling to the bottom, the dust disperses again and as a result, dust in the discharging space between the dust collecting electrodes instantaneously increases to a concentration several tens to several hundreds times higher than usual. The corona discharge in the relevant space is suppressed by such higher concentrations of dust so that the dust collecting capacity is reduced to a large extent and the concentration of dust at the exit of the precipitator is temporarily increased.

The latter method, removal of dust by means of a sliding scraper, can overcome the above-described drawbacks inherent to the hammering method while itself having a disadvantage. The prior sliding scraper is moved up and down in a sliding relation with the surface of the dust collecting electrodes. Dust scraping, however, is still not complete. Particularly, when the sliding scraper is to be moved during operation dust precipitates on the back of the scraper itself, too and the operation must be suspended to remove the dust precipitated on the back.

Another prior improvement is made on the structure of electrodes. Since the resistivity of dust which varies depending on the surrounding temperature is generally high at elevated temperatures, back ionization with sparking may often occur in the vicinity of the dust collecting electrodes, eventually decreasing the voltage applied between the electrodes and the wires. The dust collecting capacity is then reduced. To avoid such undesirable phenomenon, there is proposed a dust collecting electrode is proposed, of a hollow plate-type, through which a cooling fluid is passed to control the temperature of the electrode. The temperature of the dust in the vicinity of the cooled electrode is also decreased, resulting in a lower resistivity sufficient to prevent back ionization. British Pat. No. 643,363, is herein incorporated by reference.

Such proposals, however, deal with precipitators of a very small type used for air-conditioners or in experimental stage. The structure of electrodes which can be used on an industrial scale has never been proposed. By way of illustration, reference is made to an industrial electric dust precipitator of an electrode-cooling type. Usually, dust collecting electrodes in pairs are spaced apart from each other at a distance of 200 to 250 mm (the distance between opposite electrodes means the distance between the centers of opposite electrodes). Since the dust collecting electrode is hollow and cooling water can be passed therethrough, the wall of the electrode must be thick, for example 20 to 50 mm in thickness. The effective dust collecting space is then reduced by about 10 to 25% by volume. The rate of gas flow in the precipitator increases in proportion to the above reduction and hence the charging time is shortened and the lesser the charging time, the lesser the dust collection.

Since the distance between the opposite dust collecting electrodes is small, for example 200 to 250 mm, the number of electrodes set within a unit volume is increased and the dust collecting area and hence the heat transfer area are large. This in turn requires a larger amount of cooling water. If the amount of cooling water is reduced below a certain level, the difference in the temperature of the cooling water at the entrance and the exit is considerably larger. When the temperature of the cooling water at the entrance is maintained above the dew point of the gas to prevent the corrosion of the electrodes, the upper portions of the electrodes which are near the exit of the water and hence the dust on the upper portions are cooled insufficiently. Therefore, the dust on the upper portions is hardly cooled below a critical level for back ionization. Particularly, when the distance between the dust collecting electrodes is within 200 to 250 mm, ionic wind flows at higher velocities along the electrodes, the temperature of dust on the surface of the electrodes increases and consequently, it becomes difficult to extinguish back ionization under these conditions. Further, the ionic wind at higher velocities makes a boundary film on the surface of the electrodes thinner, increasing the quantity of heat required for cooling. This adds to the above-described increase of heat transfer area creating further multiplied adverse effects to the system. To overcome such influences, it is required to substantially increase the capacities of a pump, a cooler and other equipment included in a system for circulating the cooling water. As a result, not only the costs for installation and operation of the precipitator are too high, but also the efficiency of dust collection is adversely affected. These problems in the foregoing, mainly comprise a hindrance to the application of the industrial electric dust precipitator as commercially available equipment.

The prior means for controlling the temperature of electrodes, for example, in the case of a cooling system, deals with only the temperature of the cooling water. Since back ionization has a variable relation with the temperature, such means cannot follow such variations, resulting in incomplete prevention of back ionization.

Further, the prior dust collecting electrode through which a cooling fluid is passed is of a hollow plate type. This structure includes a number of welded portions where mechanical strain readily takes place. It is then difficult to manufacture electrodes of medium and large scale. Besides, the hollow plate electrode has a flat surface and this surface area is large and consequently, dust is easily re-dispersed so that the corona discharge may often be suppressed.

Therefore, it is a primary object of this invention to obviate the above-described drawbacks and to provide an improved electric dust precipitator.

Essentially, according to the present invention there is provided an electric dust precipitator comprising a chamber, a pair of dust collecting electrode groups disposed in parallel with each other and with the direction of gas flow in said chamber and spaced apart by a distance of more than 400 mm, each electrode being made of a tubular member, except for a hollow plate type, through which a cooling fluid for controlling the temperature thereof is passed, and a plurality of discharging wires disposed in parallel with said groups and between the dust collecting electrode groups, wherein a high direct current voltage is applied between the discharging wires and the dust collecting electrodes, and a control system including a detecting means which detects the number and quantity of spark discharges caused from back ionization per unit time and a control means which controls the temperature of said cooling fluid with the aid of a detected signal.

In order that this invention may be more readily understood, reference will now be made to the accompanying drawings, in which.

FIGS. 14(A) to 14(F) are horizontal sectional views showing different embodiments of tubular electrodes, respectively.

Figure 1:
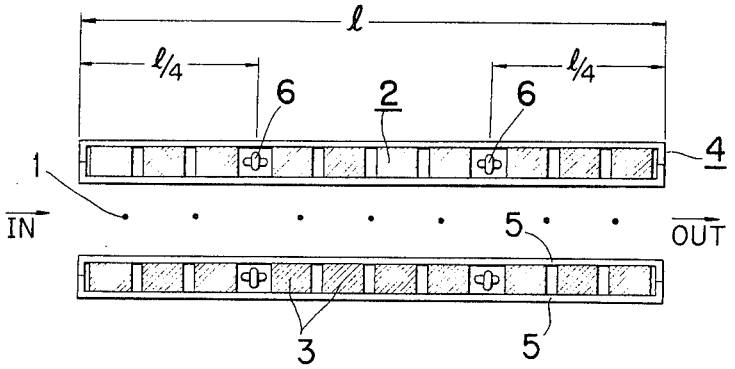
FIG. 1 is a horizontal sectional view of electrodes surrounded by a scraping means embodying the present invention.

Referring to the drawing, first of all, the embodiment relating to the removal of the dust precipitated on dust collecting electrodes will be described. In FIG. 1, the electric dust precipitator of the invention comprises a plurality of discharging wires 1 and two rows or groups 2,2 of dust collecting electrodes 3. The wires 1 are insulatedly supported and disposed in a straight line in a chamber defining a path for a gas to be treated. Two groups of dust collecting electrodes 3 are in parallel with the direction of gas flow shown by arrows. Each electrode 3 is made of an elongated tubular member having a rectangular cross section. A high direct current voltage is applied between the wires 1 and the electrodes 3 to form a discharging space therebetween. The precipitator further comprises scraping means 4,4, each slidably mounted around each group 2 of the dust collecting electrodes 3. Each scraping means 4 comprises a pair of split sliding bars 5,5.

Supporting means in the form of chains 6 in FIG. 1 are connected to the scraping means 4 with there being a pair of chains for each scraping means, to move the latter up and down. The chain 6 is vertically suspended between two adjacent electrodes in one group whereat the electrodes are spaced apart more than usual (FIG. 1) or in the peace of an omitted electrode to be aligned (FIG. 2).

The chain 6 is connected to the scraping means 4 at a point spaced inwardly from the end thereof by a distance of about a quarter ($l/4$) of the total length $l$ of the group 2 in the gas-flow direction. The flexural force applied on the sliding bar 5 is considerably reduced by mounting the chains 6 at such positions. The reduction of flexural force allows the sliding bar 5 to be thinner in order to provide a larger spacing between the groups 2,2. Because of reduced bending, the sliding bars 5 can slide along the surface of the dust collecting electrodes 3 in close contact so as to scrape off the precipitated dust uniformly and thoroughly.

Figure 4:
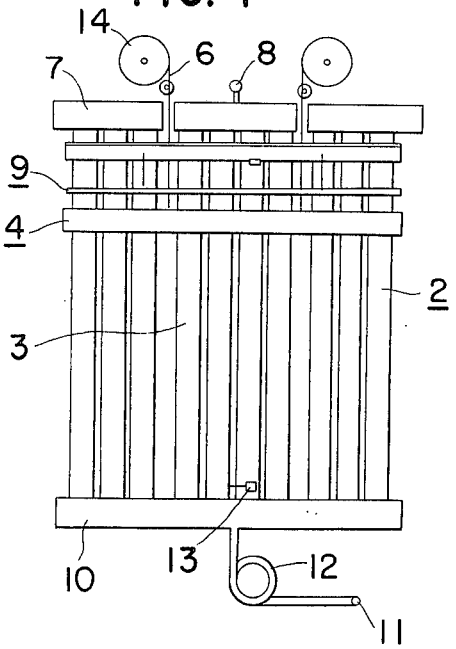

The chains 6 are wound up by winding machines 14, respectively, as shown in FIG. 4. Since the chains 6 are vertically extended through a space between adjacent electrodes 3,3 and the winding machines 14 are placed above the groups 2 of the electrodes 3 at positions located inwardly from the ends thereof, the length of the dust collecting chamber in the gas-flow direction can advantageously be reduced. On the contrary, if chains are extended along the outsides of the groups of electrodes and then winding machines for winding up the chains are placed above the electrode groups at the outside ends thereof, the dust collecting chamber in the gas-flow direction is longer because of the spaces occupied by the protruded winding machines. By placing the chains inwardly from the ends of the groups, such an inconvenience can also be omitted.

Figure 2:
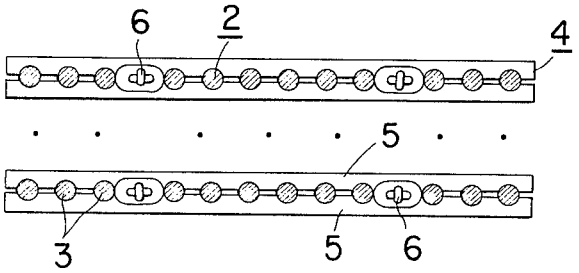
FIG. 2 is a similar sectional view of a modified form of electrodes surrounded by a different scraping means.

The dust collecting electrodes of FIG. 2 are of a cylindrical type, each group of which is also surrounded by a scraping means 4. The sliding surfaces of the sliding bars 5,5 are recessed so as to correspond with the circular surface of the dust collecting electrodes 3.

Figure 3:
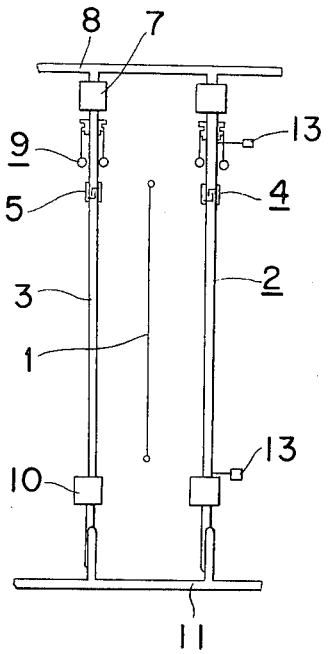
FIGS. 3 and 4 are a front and side elevational view of a precipitator embodying the present invention, respectively.

FIG. 3 is a front elevation of the electric dust precipitator of FIG. 1 viewed from the gas flow direction and FIG. 4 a side elevation thereof. The tubular dust collecting electrodes 3 belonging to one group at the top thereof are connected to a common upper header 7, which communicates with a common upper pipe 8.

The groups 2,2 of dust collecting electrodes 3 at the upper portions thereof are provided with cleaning means 9,9, respectively, which serve to remove the dust precipitated on the outer sides of the scraping means 4,4. The cleaning means 9 is arranged so that it may slidably engage with the outside surface of the scraping means 5 when the latter is moved up. Upon engagement, the space between the discharging wire 1 and the dust collecting electrode 3 is reduced due to the scraping means 4 and the cleaning means 9 being interposed therebetween which means that the insulating distance is undesirably reduced. To obviate the above drawback, the cleaning means 9 should be placed in the region having no or a weak electric field, that is, at the upper portion of the electrode 3.

The tubular dust collecting electrodes 3 belonging to one group at the bottom thereof are connected to a common lower header 10, which communicates with a common lower pipe 11 by way of a bent pipe 12 which can absorb the thermal expansion and contraction of the tubular electrodes 3. The electrodes in one group are further provided with a pair of switches 13 which abut on the ascended or descended scraping means 4,4 to sustain the further movement thereof.

The precipitator further comprises winding drivers 14 for winding up the chains 6, which are mounted above the top of the group of electrodes.

Figure 5:
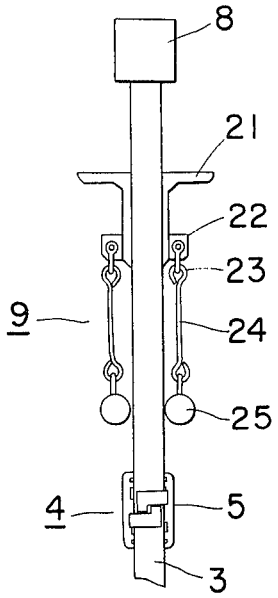
FIGS. 5 and 6 are an enlarged front and side elevational view showing a cleaning means for removing the dust precipitated on the back of the scraping means, respectively.
Figure 6:
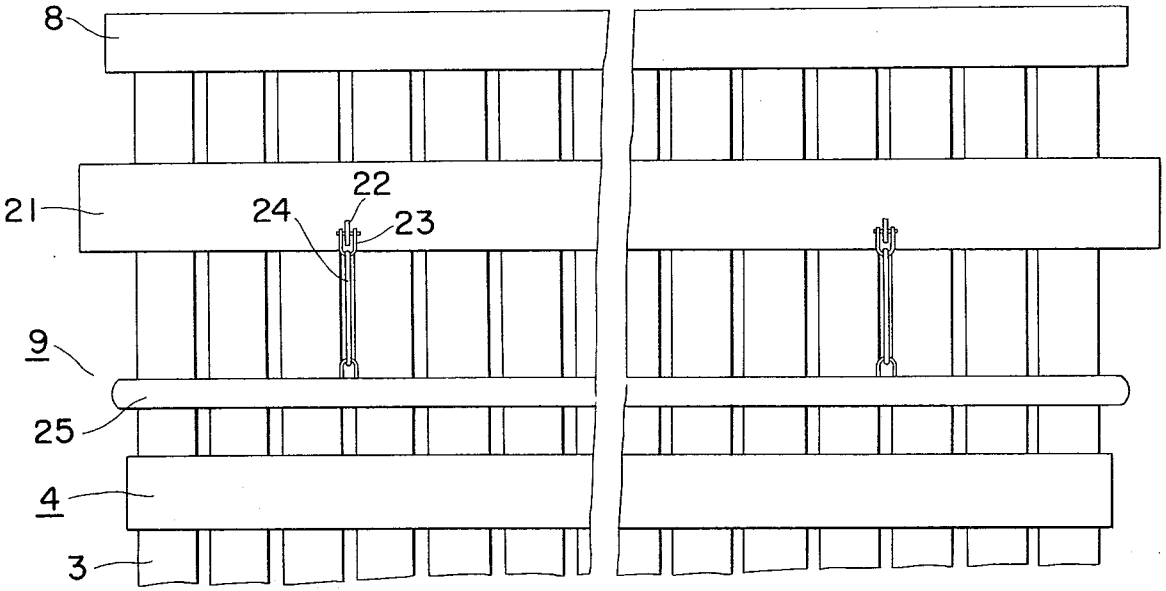

The cleaning means 9 is shown in the enlarged views of FIGS. 5 and 6. The cleaning means 9 comprises a pair of suspending beams 21, 21 which are fixed to the electrodes 3 at the upper portion thereof. Brackets 22 at the lower portions of the suspending beams 21 are provided with appropriate fixtures 23, from which are suspended connecting rods 24, from which in turn are suspended cleaning bars 25,25, respectively. This arrangement allows free movement of the cleaning bars 25 in a horizontal direction.

Operations of the scraping means 4 and the cleaning means 9 are as follows. It is assumed that the scraping means 4 first descends along the electrodes 3 from above the cleaning bars 25. The scraping means 4 descends under the influence of gravity, provided that the winding drivers 14 are released. When the sliding bars 5, 5 come in contact with the cleaning bars 25,25, the dust precipitated on the outside surfaces of the sliding bars 5,5 is cleaned off by the latter. The sliding bars 5, 5 further move downward along the electrodes 3 to scrape off the dust precipitated on the surfaces thereof. When the sliding bars 5,5 reach a predetermined lower limit, they abut on the lower limit switch 13 which is then operated to turn on the winding drivers 14 after a short quiescent time. Then the winding drivers 14 commence to wind up the chains 6 and hence bring up the sliding bars 5,5. As the sliding bars 5,5 pass the cleaning bars 25, 25, the former forces the latter outwardly. At this time, the dust, which is newly precipitated on the outside surface of the sliding bars 5, 5, is scraped off. Accordingly, the outside surface of the sliding bars are cleaned twice in a cycle and dust precipitation on the outside surface of the sliding bars 5,5 is reduced to a minimum.

Certain requirements are imposed on the winding machine 14 in FIG. 4. That is, the winding machine 14 must have a very large driving force, because it alone pulls up the heavy load. As winding up the chain 6, the length of which corresponds to that of the electrodes 3, the winding machine 14 must be extended in the direction of its axis to prevent the superposed winding of the chain 6. The embodiment of the winding means shown in FIG. 8 is improved in these aspects.

Figure 7:
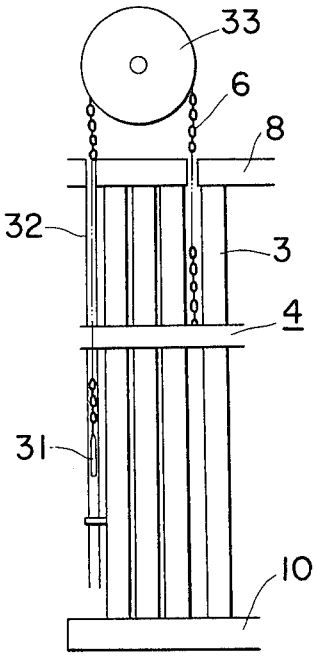
FIGS. 7 and 8 are partial side elevational views showing different embodiments of a scraping means and a suspending chain, respectively.

In FIG. 7, from the free ends of the chain 6 are suspended a counter weight 31 the weight of which is equal to about one-half that of the scraping means 4. A guide tube 32 may be provided at the outermost end of the group of electrodes and in parallel with the electrodes 3. The guide tube 32 defines a path of the counter weight 31 to prevent the latter from oscillating. If the counter weight 31 is free and oscillates, undesirable problems may be encountered. The guide tube 32 also serves as a dust collecting electrode, although it is not cooled. The guide tube 32 may advantageously be installed in the region where the least reverse ionization may occur, that is, at the site spaced apart from the discharging wire by a distance one and a half times larger than that between the discharging wire and the dust collecting electrodes.

The chain 6 extends from the point connected to the scraping means 4 to the path defined by the guide tube 32 by way of a pulley 33 which is rotated by a suitable driver (not shown). The guide tube 32 is open-ended at the bottom due to the fact that dust introduced into the guide tube 32 will freely drop out from the open end. In FIG. 7, for the clarity of illustration, the cleaning means 9 is omitted.

Figure 8:
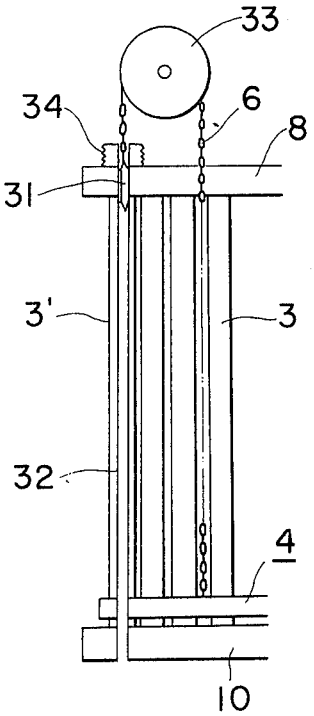

Another embodiment of the winding means modified from that shown in FIG. 7 is shown in FIG. 8. A guide tube 32 is an inner tube of a double pipe electrode 3'. The guide tube 32 is extended downwardly to pass through the lower header 10 and is open-ended at the bottom. An expansion stay 34 is mounted at the top of guide tube 32 to absorb the difference in thermal expansion between the inner and the outer tubes of the double pipe electrode 3' which may occur when cooling water in the electrodes is to be drained during operation.

Another important feature of the invention is how to determine the distance between opposite dust collecting electrodes or opposite groups of electrodes. Generally, a group of electrodes in an industrial electric dust precipitator has a length of about 2 to 5 m in the gas flow direction. It is, therefore, necessary from the standpoints of strength and function that the sliding bar 5 of the scraping means has a thickness of at least 10 to 25 mm. Each group of electrodes is surrounded by a scraping means so that the effective distance between opposite electrodes in the respective groups is reduced by twice the thickness of the sliding bar where the sliding bars are present. If the opposite electrodes are spaced apart at a distance of 250 mm (thickness of the wall of the electrodes $\leqq$ 25 mm), the effective distance may be reduced by 16 to 40% of the set value during the sliding movement of the sliding bars.

Figure 9:
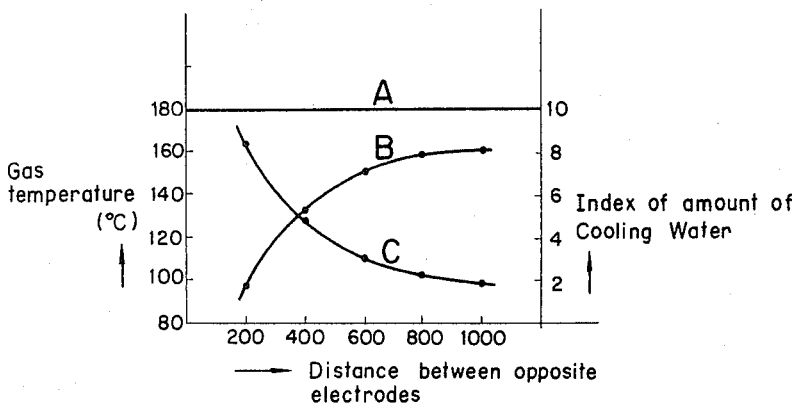
FIG. 9 is a graph showing the relations of the gas temperature and the amount of cooling water to the distance between opposite electrodes.

A test was carried out by using dust precipitators having different distances between opposite dust collecting electrodes. Relations of the distance between the dust collecting electrodes with the gas temperature at the entrance and the exit and the amount of water required to cool the electrodes are shown in the graph of FIG. 9. It is assumed that the gas temperature at the entrance of the precipitator, which is shown as the curve A in the graph, is constant and 180° C in the test. The curve B is the gas temperature at the exit and the curve C the index for the amount of water required to cool the electrodes. The gas temperature at the exit (B) is about 98° C at a distance between the electrodes of 200 mm and about 153° C at a distance of 750 mm. In accordance with this difference in temperature, the index for the amount of water (C) is decreased from 7.1 to 2.2. As seen from FIG. 9, the amount of water required to cool the electrodes is moderate or small when the distance between opposite electrodes is more than 400 mm.

Figure 10:
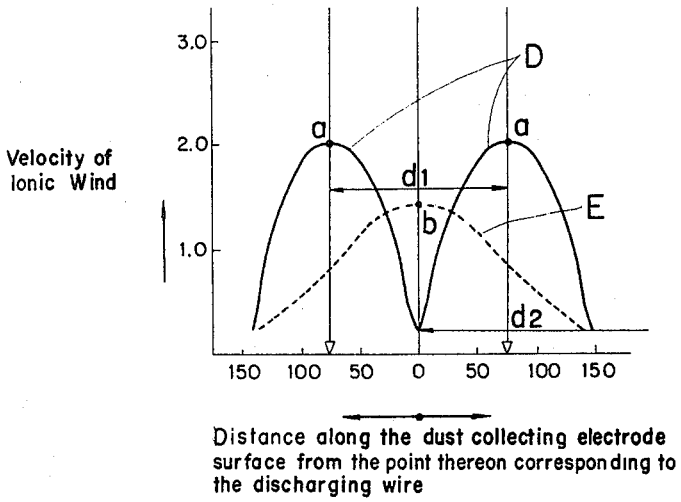
FIG. 10 is a graph showing a relation of the velocity of the ionic wind to the distance along the dust collecting electrode surface from the point thereon corresponding to the discharging wire.

FIG. 10 is a graph showing the variation of the velocity of ionic wind in precipitators of a conventional type having opposite electrodes separated at a distance of 250 mm and of a separated type having opposite electrodes separated at a distance of 750 mm. The distance between the discharging wires is 150 mm for the conventional type and 300 mm for the separated type. The area of the dust collecting electrodes for the separated type is reduced to about ⅓ of that for the conventional type. On the abscissa, the distance which is measured along the surface of the dust collecting electrode from the point thereon corresponding to the discharging wire is plotted and the number on the calibrated scale is only for the separated type. The velocity (E) of ionic wind flowing on the dust collecting electrodes of the separated type has a maximum value (*b*) which is only about 70% of a maximum value (*a*) for the conventional type. The value of ionic wind velocity for the separated type is about ½ per electrode and about 1/6 as a whole (in proportion to the ratio of discharging wires) as compared with the conventional type. Because of the reduction of ionic wind velocity as well as the reduction of average difference in gas temperature at the entrance and the exit, the amount of water required to cool the electrodes to a predetermined temperature is reduced to about ⅓ of that required for the conventional type.

Figure 11:
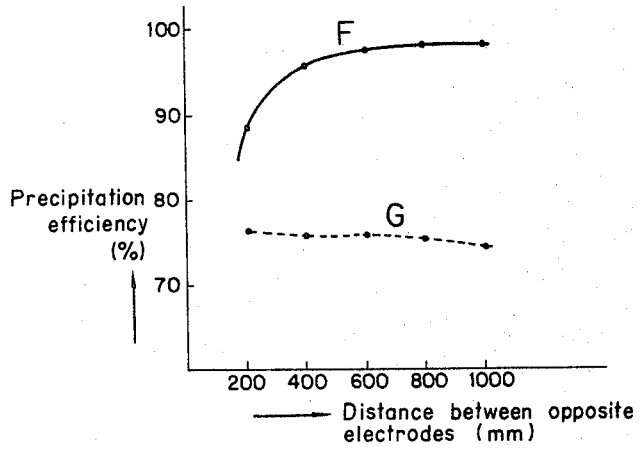
FIG. 11 is a graph showing a relation of the precipitation efficiency to the distance between opposite electrodes.

FIG. 11 is a graph showing the relation of the dust collecting efficiency with the distance between the opposite dust collecting electrodes. The curve G shown by a broken line is the efficiency obtained in the precipitator having electrodes of a flat-plate type which are not cooled. As the distance between the electrodes increases, the efficiency gradually decreases. On the other hand, in the precipitator having tubular electrodes which are cooled by water, the efficiency increases abruptly in the range from 220 to 400 mm and then gradually in the range above 400 mm. It has been found that the dust collecting efficiency is substantially improved at a distance between dust collecting electrodes of more than 400 mm.

It is concluded from the investigations carried out on FIGS. 9 to 11, that the thickness of water-cooled tubular electrodes, the amount of cooling water required and the influence of ionic wind on the resistivity of dust are substantially reduced and the operation of the scraping means is substantially improved by widening the distance between the opposite dust collecting electrodes to more than 400 mm, because the velocity of transfer of dust particles in the gas increases by a substantial proportion to the distance between electrodes. Therefore, the distance between the opposite dust collecting electrodes may preferably be more than 400 mm.

Further, an important feature of the invention is the controlling of the cooling system for the dust collecting electrodes. As described in the foregoing, the circulating water cools and controls the temperature of the dust collecting electrodes and hence, the temperature of the dust precipitated on the electrodes. At lower temperature the dust has a lower resistivity sufficient to prevent reverse ionization.

Figure 12:
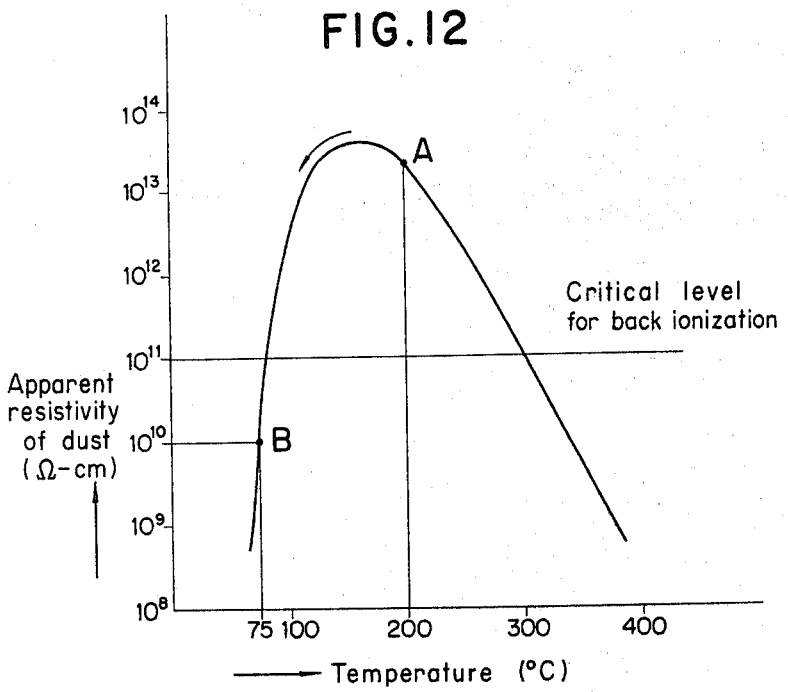
FIG. 12 is a graph showing a relation of the apparent resistivity of dust to the temperature.

A test was carried out in a precipitator by using a waste gas drained from a CO boiler provided in a fluid catcracker for petroleum refining, which gas contains dust resulting from a silica-alumina catalyst. The apparent resistivity of the dust on the ordinates is plotted against the temperature on the abscissa in FIG. 12. The dust in the exhausted gas which has a moisture content of 9% at a temperature of 200° C has an apparent resistivity of $3 \times 10^{13}$ Ω-cm, which is shown as point A. When the dust is cooled to a temperature of 75° C the apparent resistivity is reduced to $1 \times 10^{10}$ Ω-cm which is shown as point B and far below the critical level for reverse ionization ($10^{11}$ Ω-cm). The curve within temperature ranges near 75° C shows an abrupt gradient as seen from FIG. 12. A slight increase of the temperature will result in a considerable increase of the apparent resistivity, exceeding the critical level.

If the temperature of the cooling water is lowered, the difference in the cooling water temperature at the entrance and the exit of the dust collecting electrodes is larger. Under such conditions, the electrodes may readily be corroded. It is, therefore, desired to maintain electrode temperature sufficiently low to prevent reverse ionization, but not too low. A control system for controlling the temperature of cooling water which is based on the detection of occurrence of reverse ionization is rather more advantageous than the control system based on the detection of the temperature of the electrodes. Even when the critical level for reverse ionization is varied depending on variable conditions including a corona current and the like, the control system which detects the occurrence of reverse ionization can perform complete control without excessive cooling of water.

Figure 13:
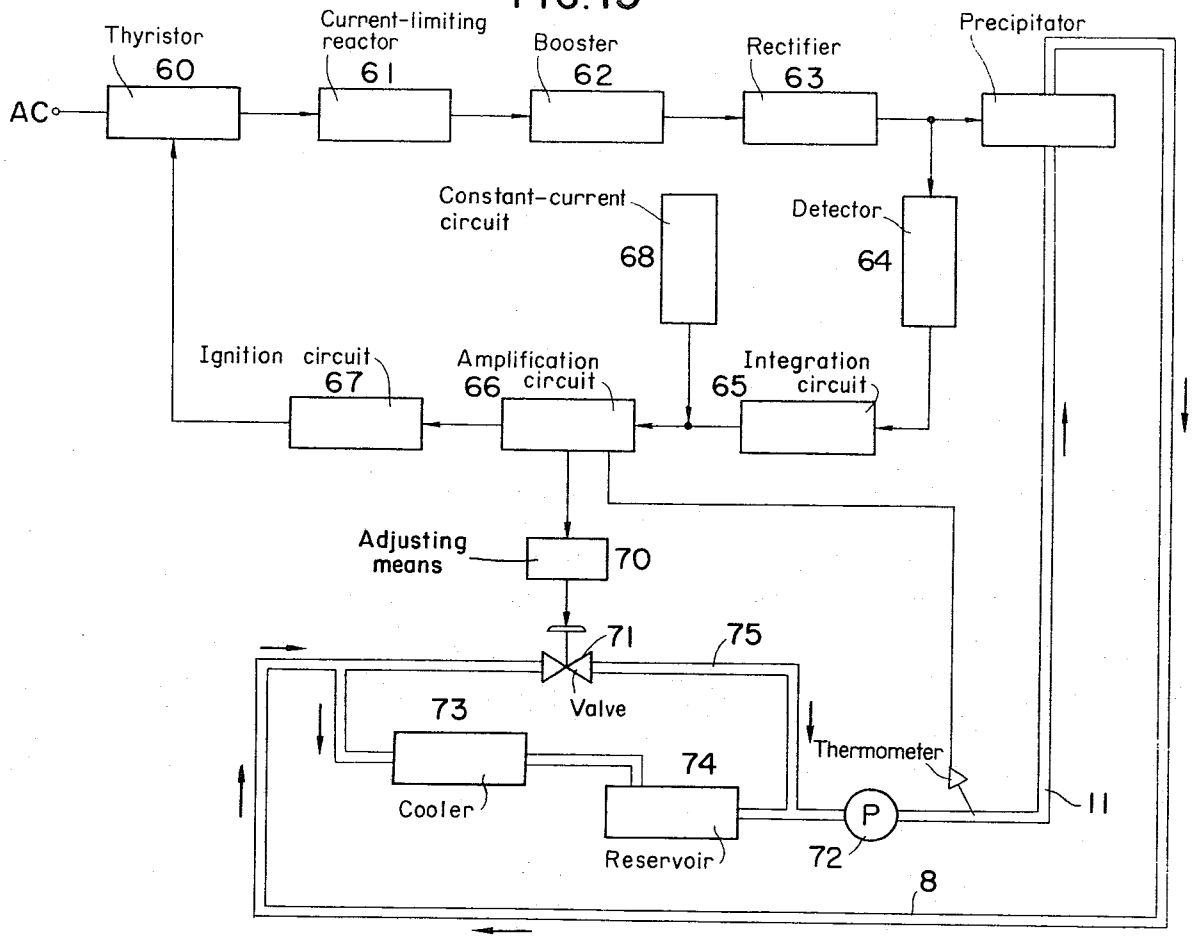
FIG. 13 is a schematic block diagram showing a control system for detecting a spark discharge and adjusting the temperature of cooling water.

The control system is diagrammatically illustrated in FIG. 13. An A.C. electric source is connected to the electric dust precipitator of the invention by way of a thyristor 60 for carrying out the phase control of the voltage applied from the source, a current limiting reactor 61, a booster 62 and a rectifier 63. The direct current high voltage at the output of the rectifier 63 is applied between the tubular dust collecting electrodes 3 and the discharging wires 1 in the precipitator. The line between the rectifier 63 and the precipitator is connected to a detector 64 which can detect a spark discharge. Upon occurrence of reverse ionization, a spark discharge takes place between the electrodes 3 and the wires 1. The output of the rectifier 63 is reversely influenced by the spark discharge, that is, a pulse current caused by the spark discharge is superposed on the direct pulsating current at the output of rectifier 63. By detecting the superposed pulse current, the detector 64 obtains a pulse signal representing the spark discharge. The detector 64 is connected in series to a pulse integration circuit 65, an amplification circuit 66 and an adjusting means 70 mounted on a valve 71 for automatically adjusting the flow rate of water. The integration circuit 65 can integrate the pulse signals from the detector 64 to obtain an integrated value corresponding to the number and quantity of sparks per unit time and generate an output signal to the adjusting means 70 when the integrated value exceeds a predetermined level. The integrated value which does not reach or exceed the predetermined level within the unit time may be cancelled automatically.

The integration circuit 65 is also connected to an ignition circuit 67 and the thyristor 60 in series by way of the amplification circuit 66. The line between the integration circuit 65 and the amplification circuit 66 is connected to a constant-current circuit 68. A circuit consisting of the constant-current circuit 68, the amplification circuit 66 and the ignition circuit 67 serves for controlling the thyristor 60 to recover the normal state at the electrodes in accordance with the signal.

Numerals 8 and 11 are pipes for circulating cooling water (see FIGS. 3 and 4). By means of a pump 72, water is pumped forward through the upstream pipe 11, the tubular electrodes 3 (not shown), the downstream pipe 8, a cooler 73 and a reservoir 74 in a cyclic manner. Between the downstream pipe 8 and the pump 72, a bypass pipe 75 is bridged in parallel with the cooler 73 and the reservoir 74. A portion of the cooling water may pass through the bypass pipe 75. At midway of the bypass pipe 75 is placed the valve 71 for automatically adjusting the flow rate of water. Receiving the signal at the output of the integration circuit 65, the adjusting means 70 may control the valve 71 to adjust the amount of water flowing through the bypass pipe 75. As a result, the amount of water to be cooled by the cooler 73 is automatically controlled.

When the integration circuit 65 generates a signal as the result of spark discharge, the valve 71 is throttled. If there is no signal, the valve is opened. Undesirable excessive cooling of water may be avoided. Thus, undesirable reverse ionization is adequately restrained at the surface of the dust collecting electrodes and stable control by means of the constant-current circuit can be carried out. Since dust precipitation is constantly maintained at maximum efficiency and the dust collecting electrodes are free from excessive cooling, the corrosion of the electrodes is substantially inhibited and the cost of operation is reduced to a reasonable level.

A final important feature of the invention concerns the structure of a tubular dust collecting electrode through which cooling water may be passed.

The conventional electrode is generally of a hollow flat plate type and therefore, includes a number of welded portions susceptible to strain. When a medium or large scale dust collecting electrode having a height of about 8 to 13 m is desired, it is difficult to manufacture same, because a number of welded portions susceptible to strain are included. Besides, the hollow plate type electrode has a flat surface causing undesirable redispersion of dust and consequently, corona discharge is disadvantageously suppressed.

To obviate the above drawbacks, it is contemplated to employ a tubular dust collecting electrode. In a preferred embodiment, the tubular electrode may be an elongated tube rectangular or circular in cross section. In the case of the tubular electrode having a rectangular cross section, the width and the length in the rectangular section are, for example, about 20 to 50 mm and about 50 to 200 mm, respectively. The electrodes are spaced apart at a distance of 10 to 40 mm in the same group. By designing the electrode in such a shape, it is possible to manufacture the electrode having a large height without undesirable surface strain.

Figure 14A:
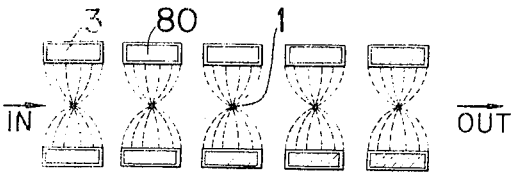

Several embodiments of the tubular electrode according to the invention are illustrated in horizontal cross-sectional views of FIGS. 14(A) to 14(F). In FIG. 14(A), the electrodes 3 in the form of an elongated tube rectangular in cross section are aligned in two rows in the gas-flow direction. The space between two adjacent electrodes 3 in the same row is 10 to 40 mm and serves as a dust pocket through which the free scraped dust drops. The dust precipitated on the side walls of the electrodes 3 drops between two adjacent electrodes when removed from the walls by means of the scraping means (not shown). The dust is prevented from dispersing again to any great extent. Numeral 80 is cooling water passed through a hollow chamber defined within the tubular electrode 3.

Figure 14B:
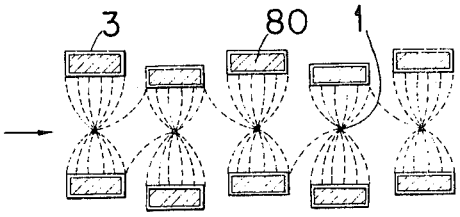

In FIG. 14(B), the electrodes 3 having the same form as in FIG. 14(A) are zigzaggedly aligned in each row in the gas flow direction, which arrangement may be more effective in preventing the re-dispersion of dust.

Figure 14C:
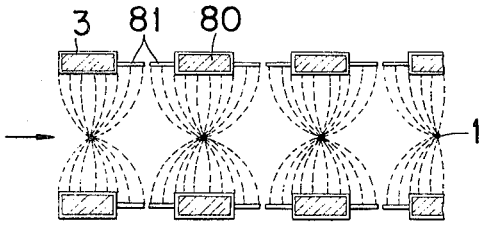

In FIG. 14(C) the electrodes 3 are provided with a fin 81 at one side or fins 81 at both sides. This structure may save cooling water, may prevent the dropping dust from redispersing and further, the weight of the electrode may be lighter.

Figure 14D:
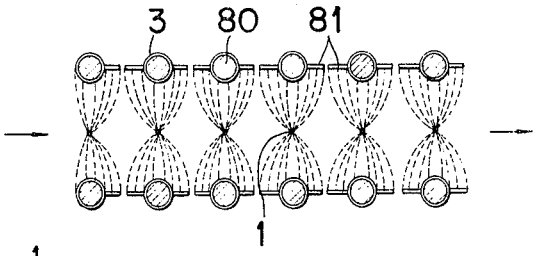

In FIG. 14(D) the electrodes 3 in the form of an elongated cylindrical tube with a fin or fins 81 are aligned in two rows in the gas flow direction.

Figure 14E:
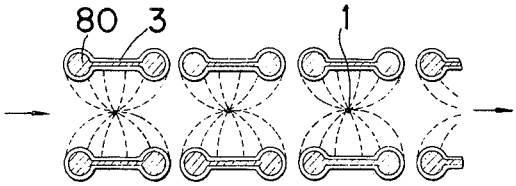

FIG. 14(E) shows the electrodes 3 in the form of a tube having a cross section similar to a dumbbell. The dumbbell-like tube may be manufactured by deforming a cylindrical tube at the center thereof so as to have smaller cylindrical portions at both sides.

Figure 14F:
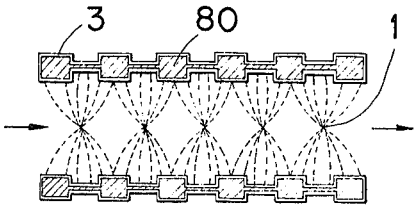

FIG. 14(F) shows the two electrodes 3 of a connected type. Such a continuous electrode may be obtained by facing two plates in which rectangular recesses are formed at regular intervals and spot welding at points where the flat portions adjoin each other. In this case, the electrode in one side comprises an integrated member.

Finally, experimental operations are carried out with a precipitator having different distances between the opposite dust collecting electrodes. The precipitator is equipped electrodes in the form of a rectangular tube as shown in FIG. 14(A), the scraping means 4 as shown in FIGS. 3, 4 and 5 and the cooling system as shown in FIG. 13. The opposite electrodes are spaced apart at a distance of 750 mm. In a comparative test, they are spaced at a distance of 250 mm. A waste gas drained from a CO boiler equipped in a fluid cat-cracker for petroleum refining is fed to the precipitator. Results are shown in the following Table.

TABLE

| | Unit | Distance 250mm Water-cooled | Distance 750mm No cooling | Distance 750mm Water-cooled |
|---|---|---|---|---|
| Flow rate of gas | $Nm^3/hr$ | 221,000 | 221,600 | 222,300 |
| Gas temperature at entrance | °C | 180 | 180 | 181 |
| Gas temperature at exit | °C | 107 | 171 | 153 |
| Dust content in gas at entrance | $g/Nm^3$ | 0.80 | 0.80 | 0.81 |

TABLE-continued

| | Unit | Distance 250mm Water-cooled | Distance 750mm No cooling | Distance 750mm Water-cooled |
|---|---|---|---|---|
| Dust content in gas at exit | $g/Nm^3$ | 0.68 | 0.13 | 0.008 |
| Charging voltage at 1st region | KV | 21.8 | 61.0 | 105.0 |
| Charging voltage at 2nd region | KV | 29.5 | 59.0 | 102.0 |
| Charging voltage at 3rd region | KV | 30.0 | 58.0 | 106.0 |
| Charging current at 1st region | mA | 840 | 450 | 305 |
| Charging current at 2nd region | mA | 705 | 320 | 265 |
| Charging current at 3rd region | mA | 685 | 250 | 223 |
| Cooling water temperature at entrance | °C | 70 | — | 70 |
| Flow rate of water | $m^3/hr$ | 440 | — | 160 |
| Precipitation efficiency | % | 91.5 | 83.7 | 99.0 |

2

What is claimed is:

1.

An electric dust precipitator comprising a pair of groups of elongated tubular dust-collecting electrodes disposed in a chamber, said pair of groups being disposed in opposing, substantially parallel, spaced-apart relationship to each other and defining a gas-flow path therebetween with the transverse distance between said pair of groups being more than 400 mm, means for circulating a cooling fluid through the interiors of said electrodes for controlling the temperature thereof to reduce back ionization, a plurality of elongated discharge wires extending in parallel with said dust-collecting electrodes and being disposed in said gas-flow path between said pair of groups, means for applying a high direct current voltage between said wires connected as the negative electrodes and said dust-collecting electrodes connected as the positive electrodes whereby to negatively charge dust particles in the gas that flows through said gas-flow path so that the charged dust particles are attracted to said dust-collecting electrodes, and two elongated scraping means respectively surrounding the dust-collecting electrodes of the respective groups, each of said scraping means consisting essentially of two sliding bars adapted to slide lengthwise along both side surfaces of said electrodes of its associated group, said scraping means being suspended by chains at points located a predetermined distance inwardly from the longitudinal ends of said bars.

2. The precipitator as claimed in claim 1, including driving means for moving said chains and thereby moving said scraping means lengthwise along said electrodes.

3. The precipitator as claimed in claim 1 wherein each of said dust-collecting electrodes is spaced a distance of 10 to 40 mm from the adjacent electrode of its group.

4. The precipitator as claimed in claim 1 wherein each of said dust-collecting electrodes has a length in the direction of the gas flow of 50 to 200 mm.

5. The precipitator as claimed in claim 1 wherein said dust collecting electrodes are provided with a fin or fins extending in the lengthwise direction of the gas flow path.

6. The precipitator as claimed in claim 1 wherein said dust-collecting electrodes in each group are transversely offset from one another in the lengthwise direction of the gas flow path.

7. The precipitator as claimed in claim 1 wherein said tubular dust-collecting electrodes have dumbbell-like cross sections.

8. The precipitator as claimed in claim 1 wherein each of said dust-collecting electrode groups is made of two opposed plates having mutually offset recesses formed therein at regular intervals, said plates being joined to each other at locations between said recesses.

9. The precipitator as claimed in claim 1 in which each of said groups of dust-collecting electrodes consists essentially of a plurality of upright electrodes that extend substantially parallel to each other and are arranged in a generally planar upright array, said discharge wires being arranged in a planar upright array between said groups of electrodes, the length of said discharge wires being shorter than the length of said dust-collecting electrodes so that said dust-collecting electrodes extend beyond both ends of said discharge wires, two pairs of generally horizontal cleaning members, each pair of cleaning members being mounted in association with one of said groups of electrodes at positions vertically spaced above the upper ends of said discharge wires, the cleaning members of each pair being arranged on opposite sides of its associated group of electrodes for contact with the outer surfaces of said scraping bars to dislodge dust that adheres thereto, said cleaning members being suspended for swinging movement toward and away from said electrodes.

10. The precipitator as claimed in claim 1 in which the transverse distance between said groups of electrodes is from more than 400 mm up to about 1000 mm.

11. The precipitator as claimed in claim 1 wherein each of said chains has a free end and a counter weight attached to the free end of each of said chains.

12. The precipitator as claimed in claim 11 wherein said counter weight is guided in a guide tube which is located spaced from said discharge wires a distance at least 1.5 times larger than the distance between said dust-collecting electrodes and said discharge wires.

13. The precipitator as claimed in claim 11 wherein said counter weight is guided in a guide tube which is disposed within one of said dust-collecting electrodes so as to move longitudinally therein.

14. An electric dust precipitator comprising a pair of groups of elongated tubular dust-collecting electrodes disposed in a chamber, said pair of groups being disposed in opposing, substantially parallel, spaced-apart relationship to each other and defining a gas-flow path therebetween with the transverse distance between said pair of groups being more than 400 mm, means for circulating a cooling fluid through the interiors of said electrodes for controlling the temperature thereof to reduce back ionization, a plurality of elongated discharge wires extending in parallel with said dust-collecting electrodes and being disposed in said gas-flow path between said pair of groups, means for applying a high direct current voltage between said wires connected as the negative electrodes and said dust-collecting electrodes connected as the positive electrodes whereby to negatively charge dust particles in the gas that flows through said gas-flow path so that the charged dust particles are attracted to said dust-collecting electrodes, two elongated scraping means respectively surrounding the dust-collecting electrodes of the respective groups, each of said scraping means consisting essentially of two sliding bars adapted to slide lengthwise along both side surfaces of said electrodes of its associated group, and cleaning means disposed in a region having a nil or weak electric field for cleaning the outside surface of said two scraping means.

15. The precipitator as claimed in claim 14 wherein said cleaning means are suspended for movement toward and away from said scraping means.

16. An electric dust precipitator comprising a pair of groups of elongated tubular dust-collecting electrodes disposed in a chamber, said pair of groups being disposed in opposing, substantially parallel, spaced-apart relationship to each other and defining a gas-flow path therebetween with the transverse distance between said pair of groups being more than 400 mm, means for circulating a cooling fluid through the interiors of said electrodes for controlling the temperature thereof to reduce back ionization, a plurality of elongated discharge wires extending in parallel with said dust-collecting electrodes and being disposed in said gas-flow path between said pair of groups, means for applying a high direct current voltage between said wires connected as the negative electrodes and said dust-collecting electrodes connected as the positive electrodes whereby to negatively charge dust particles in the gas that flows through said gas-flow path so that the charged dust particles are attracted to said dust-collecting electrodes, means for detecting the number of current pulses generated by spark discharges caused by back ionization and providing an electrical signal indicative thereof, means for integrating said signal, a cooler for cooling the fluid circulating through said dust-collecting electrodes, a valve mounted to control the amount of said fluid that circulates through said cooler and means for operating said valve in response to a signal from said integrating means.

* * * * *